US008172165B2

(12) United States Patent
Tuovinen

(10) Patent No.: US 8,172,165 B2
(45) Date of Patent: May 8, 2012

(54) DEVICE AND METHOD FOR DEFIBRATION OF WOOD

(75) Inventor: Olli Tuovinen, Tampere (FI)

(73) Assignees: Metso Paper, Inc. (FI); Myllykoski Oyj (FI); Stora Enso Oyj (FI); M-Real Oyj (FI); UPM-Kymmene Oyj (FI)

( * ) Notice: Subject to any disclaimer, the term of this patent is extended or adjusted under 35 U.S.C. 154(b) by 618 days.

(21) Appl. No.: 12/298,793

(22) PCT Filed: Apr. 28, 2006

(86) PCT No.: PCT/FI2006/000140

§ 371 (c)(1),
(2), (4) Date: Mar. 26, 2009

(87) PCT Pub. No.: WO2007/125152

PCT Pub. Date: Nov. 8, 2007

(65) Prior Publication Data

US 2009/0308549 A1 Dec. 17, 2009

(51) Int. Cl.
*B02C 19/00* (2006.01)

(52) U.S. Cl. ..... 241/28; 241/282; 241/293

(58) Field of Classification Search ..... 241/28, 241/282, 293; 144/359, 218
See application file for complete search history.

(56) References Cited

U.S. PATENT DOCUMENTS

| | | | | |
|---|---|---|---|---|
| 2,769,286 | A | 11/1956 | Beth | |
| 2,934,279 | A * | 4/1960 | Nestor et al. | 241/200 |
| 3,153,511 | A | 10/1964 | Atack et al. | |
| 4,381,217 | A | 4/1983 | Turkia | |
| 6,241,169 | B1 | 6/2001 | Bjorkqvist | |
| 7,819,149 | B2 * | 10/2010 | Lucander et al. | 144/359 |
| 2004/0250897 | A1 | 12/2004 | Tuovinen | |

FOREIGN PATENT DOCUMENTS

| | | |
|---|---|---|
| CA | 1 267 293 | 4/1990 |
| FI | 68268 | 4/1985 |
| JP | 3-208560 | 9/1991 |
| JP | 2004-255519 | 9/2004 |

OTHER PUBLICATIONS

D. Atack and W.D. May; *Mechanical Pulping Studies with a Model Steel Wheel*; Pulp and Paper Research Institute of Canada; Jan. 1962.

International Search Report for PCT Application No. PCT/FI2006/000140; Filed Apr. 28, 2006; Date of Completion Dec. 22, 2006; Date of Mailing Jan. 23, 2007.

International Preliminary Examination Report for PCT Application No. PCT/FI2006/000140.

Notification of the Recording of Change for Myllykoski Oyj.

Notification of the Recording of Change for Stora Enso Oyj.

Notification of the Recording of Change for M-Real Oyj.

Notification of the Recording of Change for UPM-Kymmene Oyj.

* cited by examiner

*Primary Examiner* — Mark Rosenbaum

(74) *Attorney, Agent, or Firm* — Alston & Bird LLP

(57) ABSTRACT

A device for mechanical defibration of wood comprises a defibration surface for processing of wood raw material and loosening of fibers, said defibration surface comprising grinding grits fastened on a metal base surface. The grits (1) fastened on the metal base surface (2) are positioned within a determined distance from each other on the base surface, so that they form a regular defibration surface.

28 Claims, 6 Drawing Sheets

DEVICE AND METHOD FOR DEFIBRATION OF WOOD

FIELD OF THE INVENTION

The invention relates to a device according to the preamble of the appended claim 1 for mechanical defibration of wood, comprising a defibration surface for processing of wood raw material and loosening of fibers, said defibration surface comprising grinding grits attached to a metal base surface. The invention also relates to a method in which wood raw material is processed and fibers are loosened by means of a moving defibration surface that is formed on a metal base surface and is in contact with the wood.

BACKGROUND OF THE INVENTION

Mechanical defibration of wood can be implemented either by grinding or refining. Both methods are based on kneading wood raw material by means of pressure pulses and mechanical separation of fibers from each other. The idea behind the processing is to prepare the wood raw material so that the subsequent mechanical separation of fibers from each other would produce pulp suitable for papermaking, not only wood fibers separated from each other. In the grinding process to which this invention relates, the above-described series of actions is implemented by pressing logs of wood in transverse direction against a rotating cylindrical grinder stone, thus keeping the longitudinal direction of the logs of wood in parallel with the axis of the grinder stone. Grinding segments are attached on the surface of the grinder stone, said segments being composed of wear-resistant grinding grits. The grinding grains in the segments typically form an irregular three-dimensional defibration surface. In the direction of the periphery of the surface, the difference in height due to the random location of the grinding grits produces pressure pulses on the wood raw material. Pressure pulses cause deformations and generation of heat in the wood raw material and as a result of this the wood material becomes softer. The friction between the grinding grits and the wood loosens fibers from the surface of the wood raw material. The greatest drawback of these mechanical defibration methods is their high energy consumption due to the extensive generation of heat. Another weakness is the fact that the properties of the grinding surface, such as the distance between the grinding grits cannot be controlled precisely in said three-dimensional structure. Thirdly, in such a structure all grinding grits have similar characteristics, wherein it is not possible to affect the pressure pulses produced by the grits and the loosening of the fibers independently of each other. Examples of such grinder stones for defibration of wood are disclosed in the U.S. Pat. No. 2,769,286 and in the Finnish patent 68268, whose counterpart is inter alia Canadian patent 1267293.

The U.S. Pat. No. 3,153,511 discloses a device whose defibration surface contains protrusions of a predetermined size at certain intervals. The device may be a rotating cylindrical element in which the grinding surface is composed of sectors positioned successively in the rotating direction and separated from each other by means of spacers. The manufacture of the grinding surface is not discussed in this publication and only metal or abrasion resistant plastic are mentioned as manufacturing materials of the tool. The test results of the device are discussed in the article: Atack, D. and May, W. D., 1962, Mechanical pulping studies with a model steel wheel, Pulp and Paper Magazine of Canada, Vol. 63:1, T10-T20. According to these results the device does not work because the grinding surface was composed of completely smooth metal protuberances that produce only treatment that heats the wood.

Publication FI-98148, whose counterpart is inter alia U.S. Pat. No. 6,241,169, discloses a method using energy more efficiently than conventional methods used in the industry, because the method utilizes as large an amount of the energy as possible for breaking the wood raw material structure before it changes into thermal energy. This method utilizes the wavelike shape of the defibration surface and the regular defibration surface in the peripheral direction. The manufacture of such a defibration surface used in industrial scale is challenging for example due to the precise working or formation of the wavelike metal surface.

SUMMARY OF THE INVENTION

The purpose of the present invention is to disclose a device by means of which it is possible to manufacture from raw wood fibrous pulp suitable for papermaking, using as small amount of energy as possible by means of a precisely controlled defibration process. The object of the invention is a defibration surface by means of which it is possible to control the amplitude and frequency of the pressure pulses produced in the defibration process as well as the effect of the pressure pulses on the fiber in its longitudinal direction. To achieve this aim, the device according to the invention is primarily characterized in that the grinding grits attached to the metal base surface are positioned at predetermined intervals on the base surface so that they form a regular defibration surface.

The invention is based on the idea that the defibration of the wood raw material is performed by using a regular two-dimensional defibration surface instead of a conventional random three-dimensional surface. The grinding grits are positioned on the defibration surface regularly in predetermined locations, wherein the frequency and amplitude of the pressure pulses formed in the defibration process can be controlled. Furthermore, the positioning of the grinding grits in the direction of the fiber makes it possible to direct the pressure pulses in a desired manner along the longitudinal direction of the fiber, wherein controlled local deformations are produced in the fibers. The frequency of the grinding grits on the defibration surface determines the penetration of the grits in the wood raw material and thus also regulates the amplitude of the produced pressure pulses. The longer the distance between the grinding grits, the greater is the intrusion of the grits in the wood and the stronger is the pressure pulse produced by them. By means of the distance between the grits it is possible to adjust the frequency of the pressure pulses in the direction of rotation. The frequency of the pressure pulses is also affected by the peripheral speed of the grinder stone.

On the defibration surface according to the invention the grits are positioned on the base surface in a predetermined pattern according to the following design criteria:

- The distance between the centers of the grinding grits from each other is on the average 1 to 5 times the diameter of a grinding grit,
- The grits are positioned in rows,
- The distance in the fiber direction between the centers of the grits positioned in a row from each other is 1 to 5 times the diameter of a grit,
- The distance between the centers of the grit rows from each other in the direction of movement of the defibration surface (direction of rotation of the periphery) is 1 to 5 times the diameter of a grit,
- The adjacent grit rows (successive in the direction of movement of the defibration surface) are positioned in such a manner that the shift of the centers of the grits between different rows is in the fiber direction 0.1 to 1.0 times the diameter of a grit.

When the grits are positioned as far from each other as possible, the fibers experience a greater deformation and the kneading exerted on the fibers is more extensive, which is advantageous in view of the specific consumption of energy. Furthermore, when the pressure pulses directed to a single fiber are so far from each other that areas of influence of the pressure pulses do not meet, as significant deformations as possible are produced in the fiber. This is advantageous in view of the kneading of the fibers and the specific consumption of energy. It is possible to affect this characteristic by the placement of the grits in the fiber direction.

The grinding grits attached to the defibration surface according to the invention are primarily round particles and at least 80% of the peaks of the grits on the defibration surface are substantially on the same height, thus forming an even two-dimensional defibration surface, as a result of which substantially all grinding grits are in contact with the wood raw material in the defibration process. As a result of this, the grinding grits exert substantially equal pressure pulses on the wood, contrary to the three-dimensional solution in which the heights of the grinding grits vary in view of the wood to be defibrated. As a result of this, it is possible to utilize the grinding surface according to the invention to increase the average level of pressure pulses produced by the grinding grits by increasing the feeding force exerted on the wood raw material, because the increase in force will be equally distributed among all grinding grits. Because the specific energy consumption of the mechanical defibration is dependent on the strength of the defibrating pressure pulses in such a manner that large pressure pulses are more advantageous than small ones, the specific consumption of energy can be significantly reduced when compared to the conventional defibration method in which randomly positioned irregularly shaped grits are used, said grits forming a three-dimensional structure, wherein only part of the grits are in contact with the wood raw material. In such a conventional structure the increasing grinding power of wood material causes breaking of fibers at points where grits located highest in the three-dimensional structure are positioned. At the same time the grits located lower in the three-dimensional grinding material still cause only small pressure pulses in the wood raw material. These pressure pulses only perform little kneading or loosening of fibers essential for defibration of wood, and the deformations of fibers caused by the pulses are mostly reversible and cause additional specific consumption of energy and generation of heat.

The defibration surface is advantageously formed of separate adjacently positioned segments with the above-described grinding grit distribution. The defibration surface can also be formed for example directly on the surface of a metal cylinder body.

According to a second embodiment of the invention, grinding grits of two different shapes are positioned on the defibration base surface either in separate segments or separated rows. At least one of said grit shapes is a polyhedron. According to a preferred embodiment, some of the grits are round ceramic bead-type particles by means of which it is possible to produce pressure to soften the structure of wood and the other grits are conventional, primarily roundish polyhedrons by means of which it is possible to loosen the fibers from the surface of the wood and from each other. The segments or grinding grit rows composed of different types of grits alternate on the base surface as successive zones in the direction of movement of the defibration surface (direction of rotation of the periphery).

Several advantages are reached by means of the invention. The device according to the present invention uses energy more efficiently than methods of prior art because of the regular two-dimensional structure of the defibration surface. Furthermore, as a result of the use of round bead-type grits, the fiber length of the fiber raw material produced is longer than when using conventional manufacturing methods, because the round grinding grits do not break fibers, and therefore the working characteristics of the fiber pulp are better. The positioning of the grits into rows and the shift of the rows with respect to each other can be utilized to control the kneading forces directed to the fibers, which also affects the fiber length of the pulp. By means of positioning the grinding segments and grit rows formed of different types of grits successively, it is also possible to control the loosening of fibers to comply with the desired result i.e. the fiber length of the produced pulp and the fragmented quality of the fibers. This can be attained by varying the number of different types of segments or grit rows with respect to each other. The grinding grits of polyhedral shape are advantageously primarily round polyhedrons and they have no knifelike tearing edges.

Another purpose of the invention to present a method for mechanical defibration of wood, by means of which it is possible to make the pressure pulses directed to the wood regular. The method according to the invention utilizes the advantages attained from the above-described positioning of the grits.

BRIEF DESCRIPTION OF THE DRAWINGS

In the following, the invention will be described in more detail with reference to the appended drawings, in which.

DETAILED DESCRIPTION OF THE INVENTION

Figure 1:
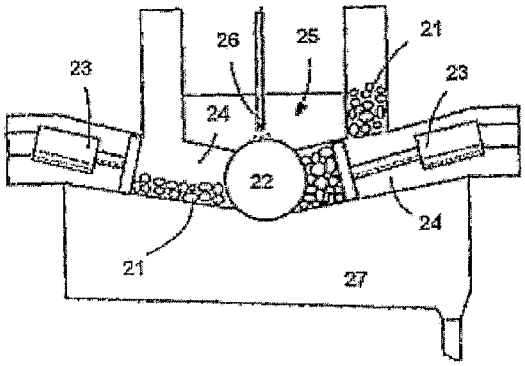
Prior Art Fig. 1
FIG. 1 shows a grinder with two chambers

FIG. 1 shows a grinding apparatus by means of which fiber is detached from logs of wood 21 or corresponding wood material by means of a rotating grinder stone 22. Thus, the logs of wood 21 are pressed by feeding means, such as feeding cylinders from a feed shaft 24 against the outer surface of the grinder stone 22. At the same time water is supplied to a grinding chamber 25 via nozzles. The fibers that have been released from the logs of wood and the sprayed water accumulate in a collecting space 27 located in the lower part of the grinding chamber, and they are conducted further therefrom to the following processing stages. The grinding apparatus is considered known as such to a person skilled in the art, wherefore it is not necessary to describe the structure and function of the grinding apparatus in more detail in this context. An arrangement corresponding to the one shown in FIG. 1 can be utilized in the present invention as well, with such a difference that the defibration surface that is in contact with wood has a novel structure.

Figure 2:
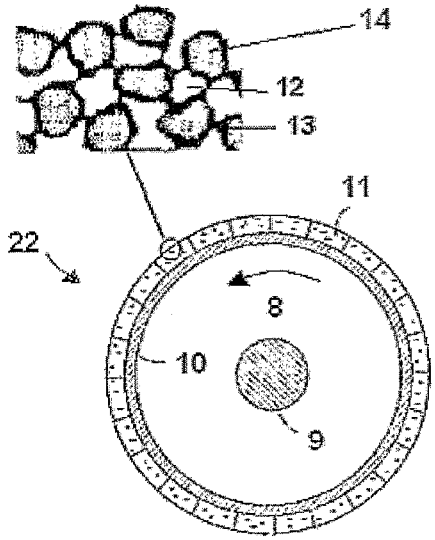
Prior Art Fig. 2
FIG. 2 shows a metal body grinder stone comprising ceramic segments, in which the grinding grits form an irregular three-dimensional structure
Figure 3:
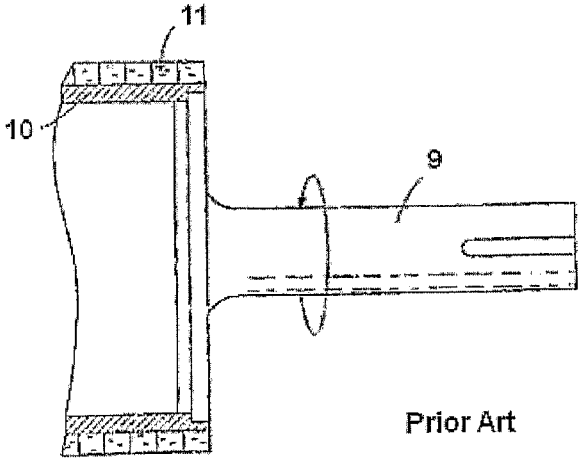
Prior Art Fig. 3
FIG. 3 shows a side view of the metal body grinder stone, FIGS. 4*a, b* show defibration surfaces according to the invention.

FIG. 2 shows in a simplified manner a grinder stone 22 of prior art that rotates around its longitudinal axis. The grinder stone 22 advantageously comprises a metal-like cylindrical body 10, on the outer periphery of which individual grinding segments 11 typically made of ceramics, suitable ceramic mixture or corresponding material have been positioned next to each other. Thus, the segments form the grinding surface of the grinder stone that works the wood, i.e. the defibration surface. The enlarged detail illustrates a three-dimensional structure according to the state of the art, in which pores 12 remain between the grinding grits attached to each other with a bonding agent 13. FIG. 3 shows a side view of the same grinder stone. The shaft with which the grinding stone 22 is rotated is marked with the reference number 9.

Figure 4A:
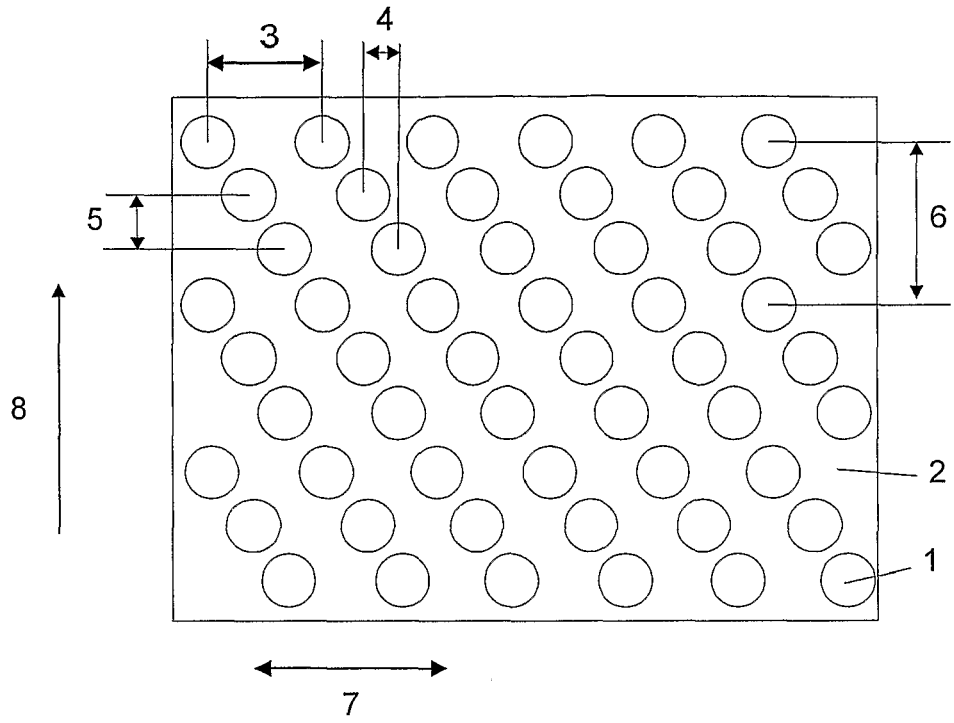
Figure 4B:
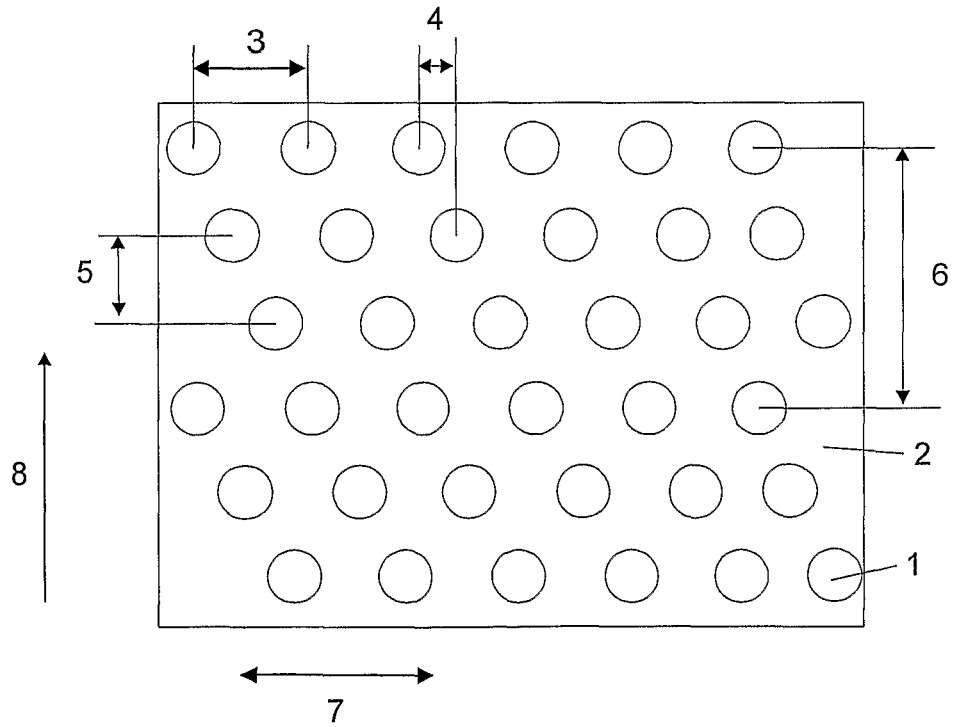

In the structure of the defibration surface of the device according to the invention the control of the frequency and amplitude of the pressure pulse is based on the fact that the grinding grits are positioned regularly on the defibration surface. FIGS. 4*a* and 4*b* show the positioning of the grinding grits 1 on the defibration surface on the basis of the above-mentioned design criteria. Even though the grits 1 are marked with circles in the figures, their shape may vary, as will be disclosed hereinbelow.

The grinding grits 1 can be thought as forming a two-dimensional regular pattern on the defibration surface. The pattern is formed of grit rows that extend substantially perpendicularly to the direction of movement 8 of the surface and succeed each other in the direction of movement of the surface.

The grinding grits 1 are positioned on the base surface 2 in such a manner that they form rows in the fiber direction 7, and the distance 3 between the centers of the grinding grits 1 in the fiber direction 7 is 1 to 5 times the diameter of a grit, advantageously 1.5 to 4 and most advantageously 2 to 3 times the diameter of a grit 1. When the diameter of the grits is 250 μm, the grits are positioned on the average at intervals of 250 to 1250 μm, and advantageously at intervals of 500 to 750 μm. As an example it is possible to say that especially for the pulping process of fine paper grades the diameter of the grits can be only 100 μm and especially for paperboard as large as 700 μm. The distances of these grits can be calculated in a similar manner as above with the diameter of 250 μm.

Because the distance between the grits in the row in the fiber direction 7 is relatively large when compared to the average diameter of the grits and as a result of this the distance between the contact points of the fiber and the grits is relatively large, the fiber is subjected to bending between the grits. Furthermore, shear force is directed simultaneously to the fiber in the direction of movement 8 of the defibration surface.

The rows of grinding grits 1 are positioned on the base surface sufficiently far away from each other so that the fibers are subjected to kneading forces when they repeatedly enter in contact with the grits and become free from the contact while between the grits. The distance between the grinding grit rows is advantageously such that the compressed fiber and fibers have time to recover sufficiently from the previous deformation before the next compression, i.e. grit row. In the direction of movement 8 of the surface (direction of rotation of the periphery) the distance 5 between the centers of the grit rows is 1 to 5 times the diameter of a grit, advantageously 1.5 to 4 and most advantageously 2 to 3 times the diameter of a grit 1. When the diameter of the particle is 250 μm on the average, the distance 5 between the grit rows is thus 250 to 1250 μm on the average, advantageously 375-1000 μm and most advantageously 500 to 750 μm. With smaller (for example down to 100 μm) and larger (for example up to 700 μm) grits the distance is dimensioned in the above-described manner. Furthermore, the grinding grit rows recur at intervals of a certain distance 6 in identical form so that the grits are aligned in the direction of movement of the surface.

In adjacent rows (successive in the direction of motion of the defibration surface) the grinding grits 1 are positioned in such a manner that their shift 4 in the fiber direction 7 is always substantially constant from one row to another. This shift is advantageously 0.1 to 1.0 times the diameter of the grit 1 (as measured from the centers of the grits), more advantageously 0.25 to 0.85 and most advantageously 0.4 to 0.7 times the diameter of the grinding grit 1. With a particle diameter of 250 μm the shift 4 between the rows is on the average 25 to 250 μm, advantageously 62 to 213 μm and most advantageously 100 to 175 μm. For smaller (for example down to 100 μm) and larger (for example up to 700 μm) grits the absolute numerical values of the shift are calculated in a corresponding manner.

Due to this shift in the fiber direction the next grit row in the direction of movement of the defibration surface (peripheral rotation direction) affects the fiber at slightly different points than the previous row. When the shift 4 between the successive grit rows is at least 0.1 times the diameter of the grit in the fiber direction, the fibers are evenly treated within the entire length of the fiber. By means of the shift so selected it is possible to make the defibration proceed in a controlled peeling front, wherein the strikes of the grits 1 are directed to such points of the fibers in which the bonds between the fibers have already become weaker and in which fibers have already started to peel from the surface of the wood. The larger the shift 4 between the rows, the larger deformation the fiber experiences, and the greater is the expectable kneading action on the fiber. On the other hand it is advantageous that the previously kneaded fiber part is not excessively kneaded, because in that case the fiber may become too damaged or it may break. On the other hand, in view of efficient specific consumption of energy it is advantageous that the defibration pulses are directed sufficiently far from each other in the fiber direction, because the fiber part that has already been treated once will not be kneaded again as efficiently as in the first time. If the distance between the grinding grits in successive rows increases too much in the fiber direction, there may be unkneaded points remaining in the fibers. The shift of the rows does not have to be regular and continuous over the entire defibration surface.

In FIG. 4*a* the distance 5 between the rows is smaller than the mutual distance 3 between the particles 1 in the row. In FIG. 4*b* the distance 5 between the rows, in turn, is larger than in FIG. 4*a*. The figures are only two examples of different positioning possibilities.

In the method according to the invention, the defibration of the wood raw material is conducted by using the two-dimensional defibration surface, as shown in FIGS. 4*a* and 4*b*. There are roundish grits attached to the defibration surface, and at least 80% of their peaks are substantially at the same height from the defibration surface, thus forming a regular two-dimensional defibration surface. These peaks of the grinding grits are inside the range of level variation having the thickness of 0 to 1 time the diameter of the grinding grit, advantageously 0 to 0.5 times the diameter of the grit, and most advantageously the range of variation is 0 to 0.2 times the diameter of the grit. Advantageously the peaks are inside the range of level variation having a thickness of 0 to 250 μm, more advantageously within the range of variation of 0 to 125 μm and most advantageously 0 to 50 μm, when the diameter of the grinding grit is 250 μm. The range of smaller or larger grits 1 is calculated in a corresponding manner. Advantageously 90% and most advantageously 95% of the vertices of the grits fulfill the above-mentioned conditions for the range of variation. In an even defibration surface substantially all grinding grits are in contact with the wood raw material in the defibration process. As a result of this, the grits direct substantially equal pressure pulses to the wood, contrary to the three-dimensional solution in which the heights of the grits vary in relation to the wood to be defibrated. As a result of this, in a two-dimensional grinding surface it is possible to increase the average level of pressure pulses produced by the grits by increasing the feed force exerted on the wood raw material, because the increase in force is equally distributed among all grinding grits. In a random three-dimensional structure the increasing grinding power of the wood raw material causes breaking of fibers at points where grits located highest in the structure are positioned. At the same time the grits located lower in the three-dimensional grinding material still cause only small pressure pulses in the wood raw material. These pressure pulses perform only a small amount of kneading or loosening work essential in view of defibrating the wood. The deformations in the wood caused by these pulses are mostly reversible and cause extra specific energy consumption and heat generation. By means of a two-dimensional defibration surface in which the grits are regularly positioned it is thus possible to considerably reduce the energy consumption in the defibration process.

The variation of the level of the defibration surface may be substantially more extensive than the variation described above, when the change takes place slowly, wherein for example the eccentricity of the stone of the grinder or the absolute surface level position changing for other reasons slowly and in a curved manner may function according to the solution of the invention. Due to the elastic properties of the wood material the material to be defibrated adapts to such slowly occurring change of the surface level, wherein the grinding process by the even defibration surface according to the invention has time to adapt to the change, and is not disturbed by the change. Thus, there may be changes in the shape of the defibration surface, and on the other hand there is not necessarily any need to pay attention to the macroscopic shape of the surface. Thus, the shape of the surface may be not only a regular cylinder, but also a plate, a band, a wavy surface or a contoured surface.

One advantage attained by means of the two-dimensional defibration surface according to the invention, when compared to a conventional three-dimensional defibration surface, is the increased production speed of the pulp in the corresponding quality level of the pulp. This results from the fact that in the two-dimensional grinding surface substantially all grinding grits are in contact with the wood to be defibrated already at a low wood feeding pressure. Thus, the number of active grinding grits is not substantially increased, even though the feeding pressure is increased. The penetration of the grits in the wood increases, but only a small amount, because at the same time the carrier surface area of the grinding grits increases quite rapidly with the increase in the wood feeding pressure. As a result of this it is possible to accelerate the production speed of pulp by means of the grinding surface according to the invention substantially without any significant change occurring in the quality of the groundwood pulp. However, in a three-dimensional grinding surface structure the amount of active grits is also small at low grinding pressure. The number of active grits that are in contact with wood increases as the grinding pressure increases. This results in that the quality of the groundwood pulp changes significantly, as the number of active grits increases. This phenomenon restricts the increase of the grinding pressure and thus the increase of the production speed of groundwood pulp with a conventional three-dimensional grinding surface.

Figure 7:
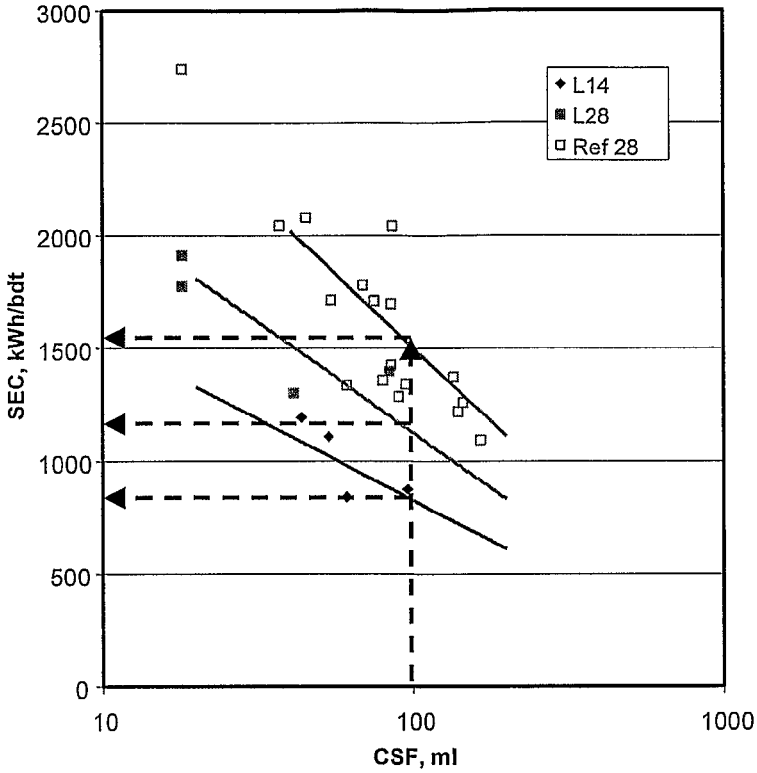
FIG. 7 shows the specific energy consumption as a function of freeness

The defibration surface according to the invention has been tested on pilot scale and FIG. 7 shows that the specific energy consumption (SEC) in the defibration process is reduced with the defibration surface according to FIG. 1 (L28) approximately 25% when compared to a conventional defibration surface (Ref 28), when the freeness (CSF) of the fiber pulp is the same in both test runs and the peripheral speed of the defibration surface is 28 mls. In a corresponding manner the specific energy consumption is reduced as much as 50% when pressure groundwood pulp is produced by the defibration surface according to FIGS. 4*a* and 4*b* at lower peripheral speed 14 mls (L14) when compared to a conventional defibration surface (Ref 28). In the defibration surface used in the test runs the diameter of the grinding grits was 300 μm, the distance between the centers of the grits was 1000 μm, the distance between the rows was 783 μm and the shift between the rows in the fiber direction was 200 μm.

Figure 8:
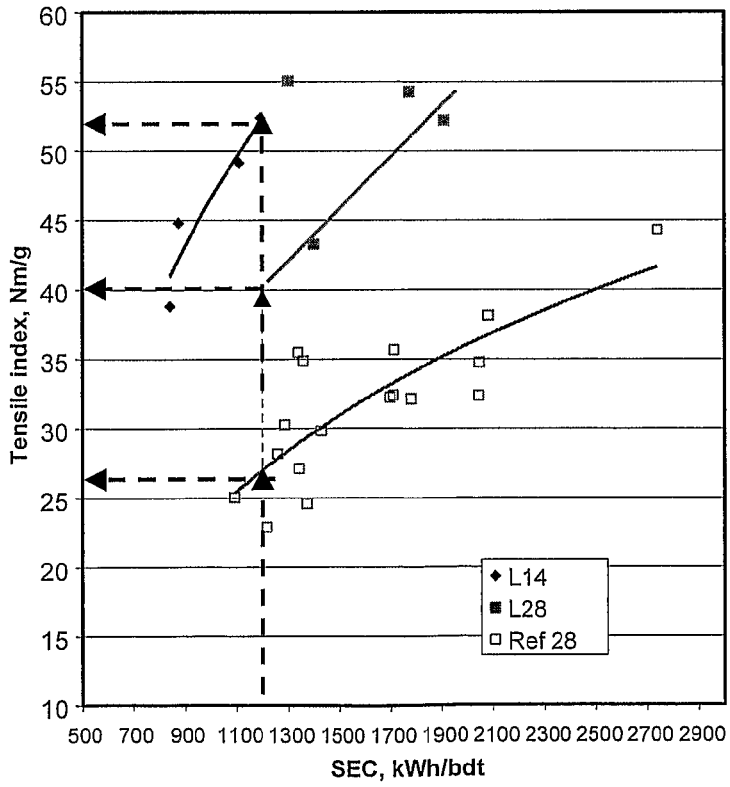
FIG. 8 shows the tensile index as a function of the specific energy consumption
Figure 9:
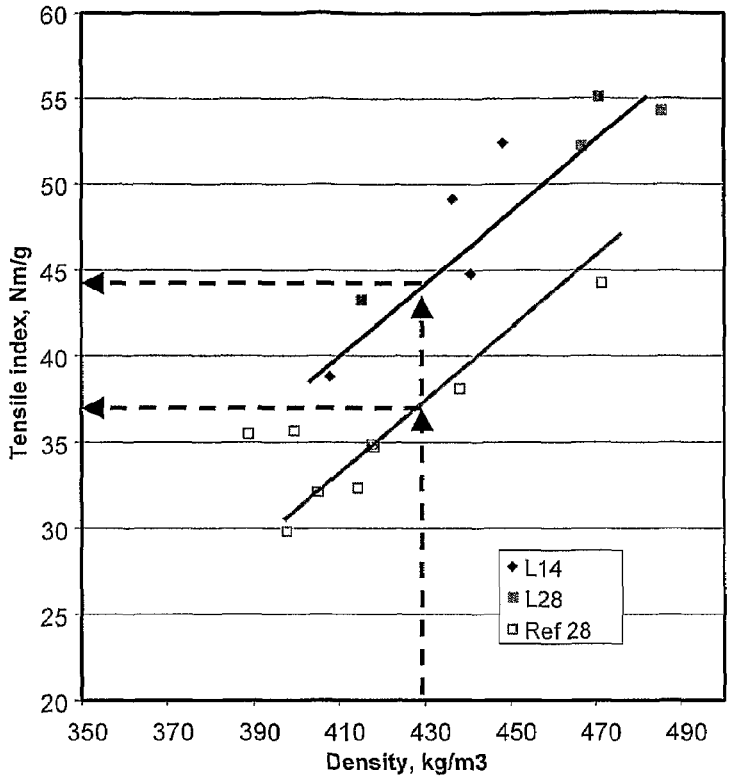
FIG. 9 shows the tensile index as a function of pulp density
Figure 10:
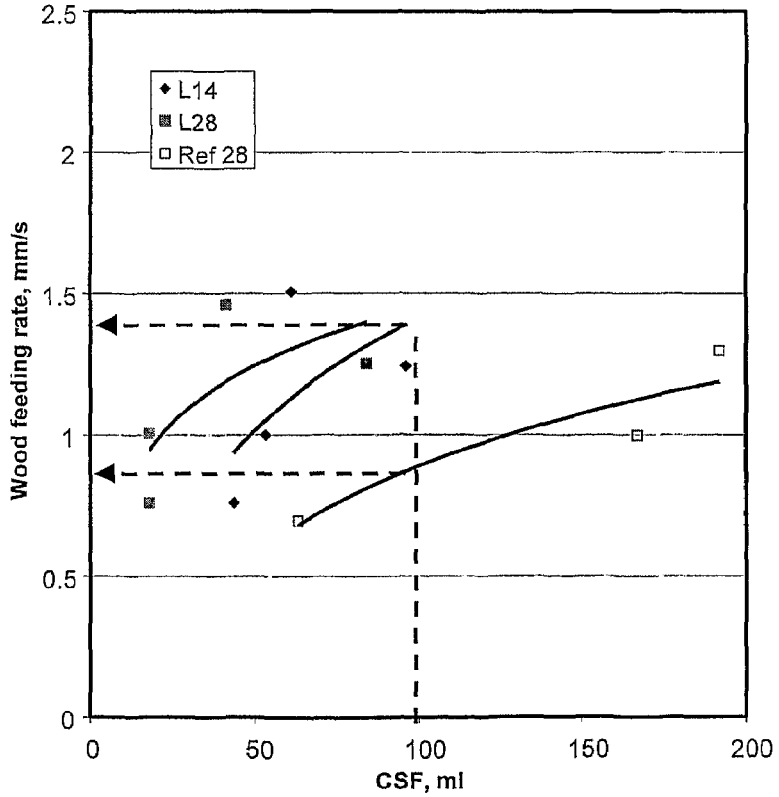
FIG. 10 shows the production speed as a function of freeness.

By means of the defibration surface according to FIGS. 4*a* and 4*b* it is also possible to attain other advantages which have been detected in laboratory test runs. FIG. 8 shows the increase in the tensile index with the same specific energy consumption of grinding, the value of the tensile index being 27 Nm/g with a conventional defibration base surface, and with the base surface according to the invention 40 Nm/g, when the peripheral speed is 28 m/s, and 52 Nm/g, when the peripheral speed is 14 m/s. As shown in FIG. 9, the tensile index also increases when pulps of equal density (430 kg/m$^3$) are used in the comparison. By means of the defibration base surface according to the invention it is possible to attain a tensile index of 44 Nm/g and by means of a conventional method a tensile index of 37 Nm/g. With the same pulp quality level it has been possible to increase the production speed to 1.4 mm/s when using a defibration surface according to the invention, in comparison to a conventional defibration surface wherein the production speed is only 0.8 mm/s, as shown in FIG. 10. The structure of the defibration surface used is the same as above.

Figure 13:
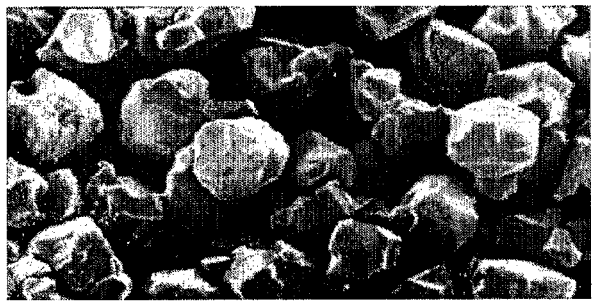
Figure 14:
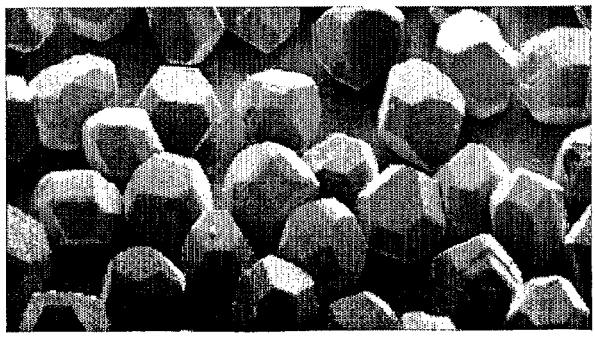

In the defibration surface according to FIGS. 4*a* and 4*b*, roundish, polyhedron-shaped grinding grits are primarily used. FIG. 13 shows two ideally shaped particles on the top, said particles not having knifelike sharp edges. FIG. 14 shows synthetic industrial diamonds that have the same advantageous shape. The fibers are not damaged and they do not break either when the grits have these shapes. Conventionally used grits with varying size distribution and irregular shape damage the fiber structure unnecessarily, thus reducing the fiber length of the fiber pulp and weakening the properties of the pulp.

Figure 11:
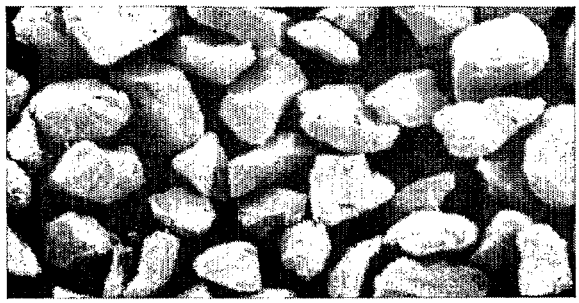
FIGS. 11 to 14 show examples of different types of grinding grits that can be used in the invention.
Figure 12:
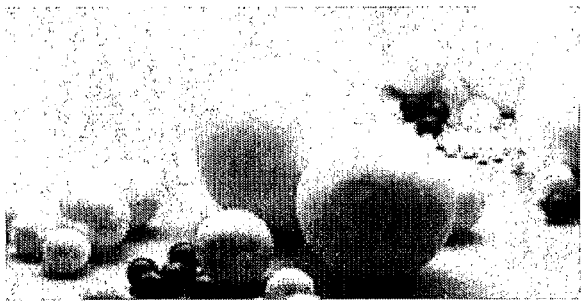

The grinding grits fastened on the defibration base surface are typically all of the same shape. Conventionally, grinding grits with varying size distribution and irregular shape have been used, their shape being shown in FIG. 11. The grits have two kinds of functions in the defibration. Firstly, their purpose is to fatigue the structure of wood by means of pressure pulses they produce. Secondly, by means of the sharp edges of the grits it is possible to loosen fibers from the surface of the wood, wherein the fibers at the same time become damaged or break. Because these two phases take place simultaneously, it is not possible to control them in a conventional three-dimensional grinding segment structure. Publication FI-98148 discloses a defibration surface structure in which the kneading and loosening work of the wood raw material take place separately from each other. This has been attained by means of a wavy surface shape, wherein these two phases alternate. The application of this method in industrial scale requires precise working or formation of the surface. In the second embodiment of the present invention, grinding grits 15, 16 of two types are positioned on a defibration base surface either in separate segments 11 (FIG. 6) or in separate rows (FIG. 5) that alternate on the base surface in successive zones in the direction of rotation of the periphery. One segment or row is composed of ceramic round bead-type grinding grits (FIG. 12) and it performs the kneading work of the wood raw material, and the other segment or row is composed of roundish, polyhedron-shaped grinding grits (FIGS. 13 and 14) that loosen fibers from the wood raw material and knead the loosening fibers. This structure enables controlling the defibration process when compared to the above-presented known methods.

The grits are positioned on the defibration surface on the basis of the same criteria as presented above. However, it is also possible that only grinding grits of one type are positioned in accordance with the invention and grinding grits of the other type are positioned on the base surface randomly.

Figure 5:
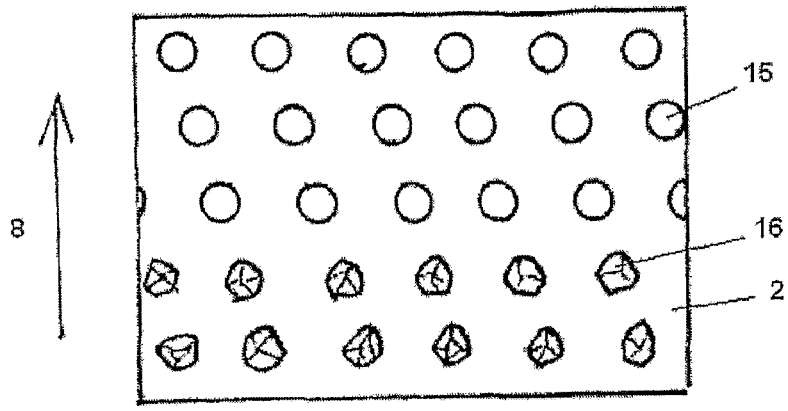
FIG. 5 shows a defibration surface according to the invention in which the grinding grits are of different types.

The grit rows formed of different types of grits 15, 16 are positioned on the base surface in such a manner that one or more bead-type (15) rows are followed by at least one row formed of roundish polyhedral grinding grits (16) as shown in FIG. 5. Such an alternating structure can be arranged in individual segments 11 of which the defibration surface is composed.

By means of the structure of the defibration surface it is possible to control the relation of the kneading and loosening phases in the defibration process by changing for example the following parameters:

- size and shape of the grinding grits
- diameter of the round bead-type grits
- relation of segments of different types in the direction of rotation of the periphery
- distance of segments of different types in relation to each other in the direction of rotation of the periphery By means of changing the relation of the kneading and loosening phases it is possible to change the properties of the fiber pulp. In practice this is attained by the selection of the mutual relation of the grinding grits of different shapes, calculated on the basis of the number of the grits. If the aim is to produce pulp containing long intact fibers, the portion of the bead-type grits (15) in the defibration surface must be large, and there may be a larger number of them than roundish polyhedral grits (16), wherein they can be especially applied in the manufacture of paperboard or newsprint pulp. Correspondingly, the portion of roundish, polyhedral grinding grits is increased when the aim is to attain more fragmented and discontinuous fibers that are suitable for printing papers of better quality, and their portion may be larger than that of pearl-type grits. The optical properties of the pulp may also be improved when the number of roundish, polyhedron shaped grinding grits is larger than the number of round bead-type grinding grits.

The grinding grits 1, 15, 16 in use must be made of hard material suitable for defibration. The diameter of the grits depends on the purpose of use of the pulp to be produced. When producing pulp used for papermaking, the diameter of the grits is typically 100 to 350 μm, and for pulp used for making paperboard the diameter is typically 300 to 700 μm. When suitable grits are selected, special attention is paid to the fact that the quality of the fibers loosened from the wood raw material is suitable in view of taking into account the purpose of use of the pulp. The evenness of the grinding surface, the quality of pulp and the energy consumption can be influenced by selecting grinding grits whose size distribution is more even than of those currently in use. In current grinding grits, the average variation of the diameter size distribution of the grits is typically +−20% and the sphericality is typically under 0.48, and the variation of the sphericality is over +−40%. In view of the evenness of the defibration surface according to the invention, and thus in view of its functionality it is advantageous that the average variation of the diameter size distribution of the grinding grits is under +−15% and the sphericality of the grits is over 0.53 and the variation of the sphericality under +−35%. As a result of the variation in the size and shape of grits more even in size and rounder than at present, it is possible to increase the fiber length of the produced pulp and reduce the specific consumption of energy.

The concept of the diameter of the grinding grit refers to the diameter of a sphere having the same volume.

The grinding grits are known hard ceramic particles. Especially the following materials are suitable for the present invention: alumina (FIGS. 11 and 13) sintered alumina (FIG. 12), natural industrial diamonds, synthetic industrial diamonds (FIG. 14), tungsten carbide, silicon carbide, zirconium oxide, CBN and hard metal.

The base surface to which the grits are fixed is made of metal, for example acid-proof steel or tool steel. The selection of the material of the metal body is influenced by the way in which the defibration surface is manufactured, so that good adhesion of the grinding grits on the base surface as well as a product with good resistance to wear, strain and corrosion are attained.

It is possible to fix the grinding grits to the metal base surface by using four different methods: active soldering in vacuum, galvanic coating, reversed galvanic coating and laser welding. For example in the active soldering method the grits are fastened on the metal base surface first into glue spots, whereafter the glue spots are possibly hardened as well, for example by means of UV radiation. The solder paste is sprayed on the defibration surface, whereafter the solder paste is melted in a vacuum furnace, wherein the particles become fixed permanently on the base surface. The second way is to spread the solder paste in corresponding recesses in the base surface which correspond to the positioning of the grits, which are positioned in the recesses for example by pressing the base surface in grit powder. The fastening of the grits to the solder takes place in a vacuum furnace. The third way is to ration the solder paste on the fastening base surface in spots for example by means of a micropipette or a printing mask, whereafter the grits are sprinkled on the surface. The grits adhere to the solder spots and fasten to the base surface in vacuum soldering when the solder melts.

Figure 6:
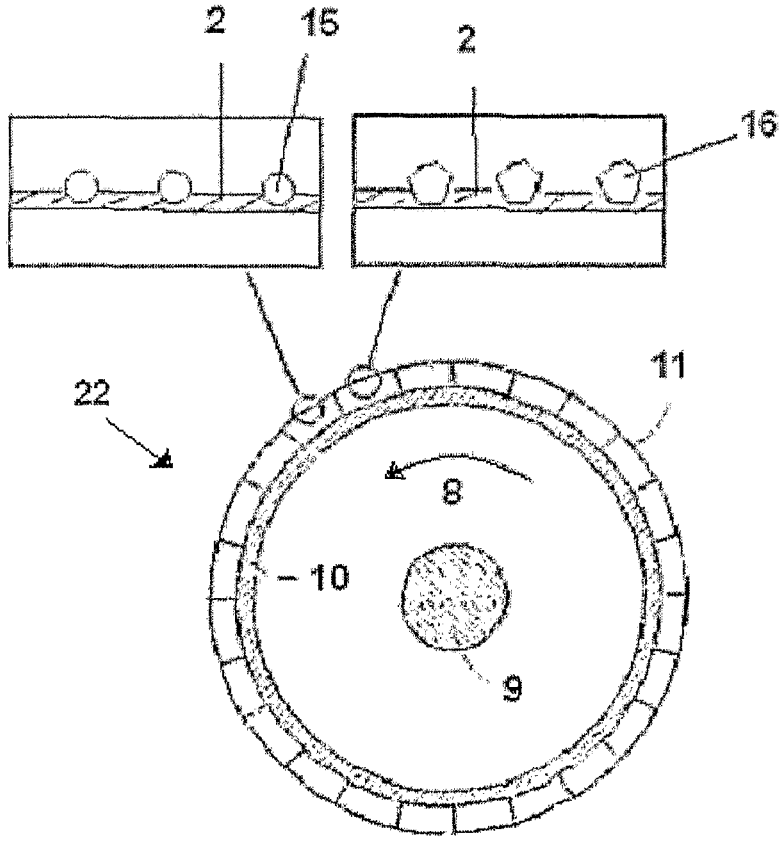
FIG. 6 shows a defibration surface according to the invention in which the grinding grits of different types are positioned in different segments of the defibration surface.

The grinder stone is formed by fastening segments 11 that follow the above-described design criteria, adjacently or successively around the cylinder 10 forming the core of the grinder stone (FIG. 6). The segments 11 on the surface of which the grits are fastened may be easily replaceable metal plates, for example steel plates. The core of the grinder stone, in turn, may have a metal body. When the defibration surface is formed of segments whose body is made of metal material and on the surface of which grits are fastened, it is possible to replace worn segments with new defibration segments rapidly without detaching the body cylinder of the defibration surface from the grinding machine. The replacement of the currently used grinder stone having a concrete body takes a many times longer time, because it is thus necessary to detach the grinder stone from the grinding machine to enable the replacement work. However, the invention also covers a grinder stone having a cylinder body made of concrete.

In the grinding process according to the invention the defibration surface moves at a certain speed in relation to the wood raw material, wherein regular pressure pulses are directed to the wood raw material, the frequency and amplitude of said pulses being controllable by the distance between the centers of the grinding grits with respect to each other, and the rotating speed of the periphery. The variable last mentioned can be changed during the defibration process. When a rotating grinder stone is used, the speed of the defibration surface is the peripheral speed of the grinder stone, which is dependent on the rotating speed.

The grinding process can be carried out without or with pressure (so-called pressure grinding process).

Conventionally, a steel roll or a high-pressure water jet is used for treatment of a three-dimensional grinding surface equipped with grinding materials to remove worn grits and to renew the grinding surface. The two-dimensional grinding surface according to the invention comprises possibly only one grinding grit surface, wherein it is not possible to renew it in the ways mentioned above. In practice it has been observed that the usable life of alumina grits in the grinding process is approximately 6 months, whereafter they become too dull, i.e. too smooth so that it would be possible to defibrate the wood. In other words, the grinding grits wear, which causes need to adjust the process, Further adjustment needs are caused for example by the variations in the quality of the wood raw material.

According to conventional control methods the grinding pressure is changed when the properties of the grinding surface change. However, this control variable changes the groundwood pulp production, wherein it is not the most effective alternative in view of groundwood pulp production. with a two-dimensional grinding surface it is advantageous to use the change of the speed of the defibration surface (peripheral speed of the grinder stone) to compensate the change in the operating point of the process, resulting for example from the wearing of the grits or changes in the wood raw material. Furthermore, it is possible to use grinding thickness, which is changed by changing the spray water streams, as a control variable of the process. Furthermore, it is possible to control the process by changing the temperature of the grinding surface either by directly heating or cooling the defibration surface. The heating can be conducted from the grinding surface side or from the inside of the body cylinder by means of water of steam or electric resistances. The temperature of the grinding surface can also be adjusted indirectly by changing the temperature or amount of spray waters.

Low peripheral speed may require larger number of grinding grits per surface area, because wood has more time to relax to the changes caused by the grits than at higher peripheral speed. For this reason, when a lower peripheral speed is used, greater penetration of grits in the wood is generated than when using high peripheral speed. If the aim is to maintain constant pulp quality also when the peripheral speed is reduced, the increase of the relaxation time must also be compensated by increasing the number of grits per defibration surface area. According to the invention this is attained by reducing the distance between the grits, wherein the number of grits per defibration surface area is increased.

Different wood species have different defibration properties, and therefore the same defibration surface may affect them in different ways. Thus, when the aim is to control the contact of the grits to the wood so that it would be suitable for different wood species, the number of grits per defibration surface is selected according to the defibration properties of the wood.

In different process temperatures the defibration properties of wood change and as a result of this, the same defibration surface may affect the wood in different ways. Thus, when the aim is to control the penetration of grits in the wood so that it would be suitable for different process temperatures, the number of grits per surface area is selected according to the process temperature in such a manner that it is larger when the process temperature rises and smaller when the process temperature falls.

In practice the number density of the grits is selected so that it is suitable by selecting a grinder stone with said density on its surface or, if necessary, by replacing the segments of the grinder stone with segments having said density.

The temperature of the defibration surface affects the temperature of the defibration process, wherein the control of the defibration by changing the temperature of the defibration surface can be implemented in a corresponding manner. The temperature of the defibration surface is affected not only by the temperature of the spray water but also by the amount of the spray water, as well as by the fact that the surface is heated up or cooled down in other ways.

The defibration surface according to the invention that comprises grits fastened on a metal base surface may contain several grit layers, if for the part of the surface layer the grits are positioned in accordance with the invention. Furthermore, the grinding surface may also be composed of several superimposed two-dimensional defibration surfaces in which the grits are positioned in accordance with the invention, wherein the new defibration surface can be produced by removing the surface layer or several grit layers for example mechanically.

The invention is not intended to be limited to the embodiments presented as examples above, but the invention is intended to be applied widely within the scope of the inventive idea as defined in the appended claims. The defibration surface of the device according to the invention can also be manufactured by methods other than those described above. It is also possible to use grinding grits having wider size distribution than the one presented above as an advantageous size distribution. The diameter mentioned above as a basis for the different distances between the particles must thus be understood as the average diameter of these grits. Furthermore, the narrowness of the size distribution of the grits is not a necessity in order to produce a defibration surface taking part evenly in the processing of wood, if the grits are seated in the metal base surface in such a manner that their peaks will lie substantially on the same level.

The invention claimed is:

1. A device for mechanical defibration of wood, comprising a defibration surface for kneading of wood raw material and loosening of fibers, said defibration surface comprising:

a metal base surface; and grinding grits made up of hard particles, the grinding grits having a diameter of 100 μm to 700 μm;

wherein the grinding grits are fixed to the metal base surface by a fixing method, and positioned so that the grinding grits form a regular defibration surface that is capable of effecting regular pressure pulses on wood as the defibration surface contacts and moves over the wood, wherein the grits are positioned in such a manner that a spacing distance between centers of the grits is 1 to 5 times the diameter of a grit.

2. The device according to claim 1, wherein the grits are positioned on the base surface so that the grits form a two-dimensional one-layer structure.

3. The device according to claim 1, wherein the defibration surface is formed of adjacent segments.

4. The device according to claim 3, wherein the device is formed by fastening segments adjacently and successively around the cylinder formed by the core.

5. The device according to claim 1, wherein the grits are positioned on the substrate in such a manner that the grits form rows that in use extend in the fiber direction of the wood.

6. The device according to claim 5, wherein the grits are positioned in the rows in such a manner that a spacing distance between centers of the grits in the fiber direction is 1 to 5 times the diameter of a grit.

7. The device according to claim 6, wherein the grit rows are positioned on the defibration surface in such a manner that a spacing distance between the rows in a direction of movement of the defibration surface is 1 to 5 times the diameter of a grit.

8. The device according to claim 7, wherein adjacent rows are shifted relative to each other in the fiber direction by a distance that is 0.1 to 1.0 times the diameter of a grit.

9. The device according to claim 1, wherein the defibration surface has grits of two different shapes.

10. The device according to claim 9, wherein grits of one shape are grits performing the kneading of wood, and grits of the other shape are grits performing the loosening of fibers.

11. The device according to claim 10, wherein the grits are of roundish polyhedron shape or bead-type shape.

12. The device according to claim 11, wherein one or several rows of bead-type particles are followed by one row formed of roundish polyhedron grits.

13. The device according to claim 9, wherein the grits of two shapes are positioned in separate segments or rows.

14. The device according to claim 13, wherein grits of one shape form a segment or row performing the kneading work of wood, and grits of the other shape form a segment or row performing the loosening of fibers, and the segments or rows performing the kneading of wood and the segments or rows performing the loosening of fibers alternate on the defibration surface in successive zones in the direction of movement of the defibration surface.

15. The device according to claim 9, wherein the grits are of roundish polyhedron shape or bead-type shape.

16. The device according to claim 15, wherein one or several rows of bead-type particles are followed by one row formed of roundish polyhedron grits.

17. The device according to claim 1, wherein the grits are fastened on the metal base surface by means of an active soldering method.

18. The device according to claim 1, wherein the grits are fastened on the metal base surface by using a galvanic coating method, a reversed galvanic coating method or a laser welding method.

19. The device according to claim 1, wherein the defibration surface is the peripheral surface of a rotatable cylindrical body.

20. A method for mechanical defibration of wood, in which wood raw material is kneaded and fibers are loosened by means of a moving defibration surface that is in contact with the wood and formed on a metal base surface, wherein grinding grits made up of hard particles and fixed to the metal base surface by a fixing method are positioned within a determined distance from each other on the metal base surface, so that the grits form a regular defibration surface, wherein the grits have a diameter of 100 μm to 700 μm and the grits are positioned in such a manner that a spacing distance between centers of the grits is 1 to 5 times the diameter of a grit, and wherein regular pressure pulses are effected on the wood by the defibration surface moving over the wood in contact therewith.

21. The method according to claim 20, wherein a moving defibration surface according to claim 2 is used therein.

22. The method according to claim 20, wherein a moving defibration surface according to claim 7 is used therein.

23. The method according to claim 20, wherein a moving defibration surface according to claim 10 is used therein.

24. The method according to claim 20, wherein a moving defibration surface according to claim 14 is used therein.

25. The method according to claim 20, wherein the quality of the produced pulp is adjusted by changing the temperature of the defibration surface.

26. The method according to claim 20, wherein the number of grits on the defibration surface per defibration surface area is selected according to a peripheral speed of the defibration surface.

27. The method according to claim 20, wherein the number of grits on the defibration surface per defibration surface area is selected according to the species of wood.

28. The method according to claim 20, wherein the number of grits on the defibration surface per defibration surface area is selected according to the process temperature.

* * * * *

UNITED STATES PATENT AND TRADEMARK OFFICE

CERTIFICATE OF CORRECTION

PATENT NO. : 8,172,165 B2
APPLICATION NO. : 12/298793
DATED : May 8, 2012
INVENTOR(S) : Tuovinen It is certified that error appears in the above-identified patent and that said Letters Patent is hereby corrected as shown below:

Column 8,
Line 22, “28 mls” should read --28 m/s--.
Line 26, “14 mls” should read --14 m/s--.

Signed and Sealed this
Eleventh Day of December, 2012

David J. Kappos

David J. Kappos
*Director of the United States Patent and Trademark Office*